US010179392B2

(12) United States Patent
Taylor et al.

(10) Patent No.: US 10,179,392 B2
(45) Date of Patent: Jan. 15, 2019

(54) MULTI_STATION FIXTURE VISE

(71) Applicants: Chris Taylor, San Diego, CA (US); Steve Grangetto, San Diego, CA (US)

(72) Inventors: Chris Taylor, San Diego, CA (US); Steve Grangetto, San Diego, CA (US)

( * ) Notice: Subject to any disclaimer, the term of this patent is extended or adjusted under 35 U.S.C. 154(b) by 59 days.

(21) Appl. No.: 15/004,081

(22) Filed: Jan. 22, 2016

(65) Prior Publication Data

US 2016/0214235 A1 Jul. 28, 2016

Related U.S. Application Data

(60) Provisional application No. 62/107,051, filed on Jan. 23, 2015.

(51) Int. Cl.
*B25B 1/02* (2006.01)
*B25B 1/10* (2006.01)
*B25B 1/24* (2006.01)

(52) U.S. Cl.
CPC ..... *B25B 1/2478* (2013.01); *B25B 1/103* (2013.01)

(58) Field of Classification Search
CPC ..... B25B 1/103; B25B 1/2478; B25B 1/2489
USPC ..... 269/43, 136, 242
See application file for complete search history.

(56) References Cited

U.S. PATENT DOCUMENTS 1,549,278 A 8/1925 Sundstrand
3,663,003 A * 5/1972 Morse ..... B23Q 3/06 269/242
3,834,435 A 9/1974 McCord, Jr.
3,861,664 A * 1/1975 Durkee ..... A63C 11/02 269/153
4,241,906 A * 12/1980 Cole ..... B25B 1/02 269/153
4,251,066 A 2/1981 Bowling
4,341,375 A * 7/1982 Romanin ..... B25B 1/103 269/153
4,429,887 A 2/1984 Smith
4,448,406 A * 5/1984 Hallberg ..... B25B 1/103 269/224
4,529,183 A * 7/1985 Krason ..... B25B 1/103 269/136
4,583,724 A * 4/1986 Huang ..... B25B 1/20 269/182
4,586,701 A * 5/1986 Oncken ..... B25B 1/103 2/906
4,653,740 A * 3/1987 Meissner ..... A63C 11/021 269/236
4,685,663 A * 8/1987 Jorgensen ..... B25B 1/103 269/244
4,736,934 A * 4/1988 Grech ..... B25B 1/103 269/110
4,934,674 A * 6/1990 Bernstein ..... B25B 1/103 269/136

(Continued)

*Primary Examiner* — Joseph J Hail
*Assistant Examiner* — Arman Milanian
(74) *Attorney, Agent, or Firm* — Mark Wisnosky

(57) ABSTRACT

A tooling fixture that provides a compact, multi-station fixture vise is described. The design provides a compact, tooling fixture that is easily assembled into multi-unit arrays for machining of large volumes of workpieces. Variations of design include the ability to hold two separate pieces to be machined by one fixture, to hold a single piece in each fixture and to attach an array of the fixtures to a base for simultaneously machining and array of parts.

10 Claims, 11 Drawing Sheets

(56) References Cited

U.S. PATENT DOCUMENTS 4,949,943 A * 8/1990 Bernstein ..... B25B 1/106 269/136
4,966,350 A * 10/1990 Chick ..... B25B 1/103 269/154
5,022,636 A * 6/1991 Swann ..... B25B 1/103 269/154
5,094,436 A * 3/1992 Stephan ..... B25B 1/08 269/153
5,098,073 A * 3/1992 Lenz ..... B25B 1/103 269/136
5,129,638 A * 7/1992 Durfee, Jr. ..... B25B 1/2405 269/282
5,172,895 A * 12/1992 Klimach ..... B25B 1/103 269/253
5,224,692 A * 7/1993 Anderson ..... B23Q 1/545 269/167
5,242,159 A * 9/1993 Bernstein ..... B25B 1/18 269/136
5,330,167 A * 7/1994 Plumb ..... B25B 1/06 269/153
5,374,040 A * 12/1994 Lin ..... B25B 1/103 269/154
5,458,321 A * 10/1995 Durfee, Jr. ..... B23Q 3/102 269/136
5,501,440 A * 3/1996 Blise ..... B25B 1/103 269/253
5,505,437 A * 4/1996 Durfee, Jr. ..... B23Q 3/102 269/136
5,535,995 A 7/1996 Swann et al.
5,634,253 A * 6/1997 Swann ..... B23Q 3/103 269/154
5,649,694 A * 7/1997 Buck ..... B25B 1/2405 269/154
5,720,476 A * 2/1998 Swann ..... B25B 1/2405 269/134
5,735,513 A * 4/1998 Toffolon ..... B25B 1/08 269/138
5,860,197 A * 1/1999 Fox ..... B25B 1/103 24/455
5,893,551 A * 4/1999 Cousins ..... B25B 1/103 269/136
5,921,534 A * 7/1999 Swann ..... B25B 1/2405 269/134
5,984,290 A * 11/1999 Durfee, Jr. ..... B25B 1/103 269/136
D417,599 S * 12/1999 Wolfe ..... D8/74
6,029,967 A * 2/2000 Wolfe ..... B23Q 3/102 269/283
6,062,553 A * 5/2000 Strehl ..... B25B 1/2452 269/153
6,105,948 A * 8/2000 Young ..... B25B 1/103 269/244
6,206,354 B1 * 3/2001 Lin ..... B25B 1/103 269/136
6,334,609 B1 * 1/2002 Chun ..... B25B 1/103 269/244
6,338,477 B1 * 1/2002 Moore ..... B25B 1/103 269/251
6,409,161 B1 * 6/2002 Wolff ..... B25B 1/18 269/134
6,826,826 B2 * 12/2004 Geary ..... B25J 9/08 29/700
6,957,809 B1 10/2005 Ferrara et al.
7,017,253 B1 * 3/2006 Riggle ..... B25B 1/103 269/276
7,845,607 B2 * 12/2010 Matthiessen ..... B23Q 1/28 248/229.12
8,020,877 B2 * 9/2011 Lang ..... B25B 1/103 279/112
8,158,242 B2 4/2012 Nishihata et al.
8,256,753 B2 9/2012 Teo
8,322,699 B2 12/2012 Prell et al.
D685,827 S * 7/2013 Sun ..... D15/140
8,646,765 B2 * 2/2014 Caldarone ..... B25B 1/103 269/111
8,939,442 B2 * 1/2015 Wang ..... B25B 1/103 269/153
9,193,040 B2 * 11/2015 Schmidt ..... B25B 1/2473
9,296,091 B2 * 3/2016 Wang ..... B25B 5/003
2006/0049566 A1 * 3/2006 Bernstein ..... B25B 1/103 269/43
2008/0203637 A1 * 8/2008 Li ..... B25B 1/103 269/71
2009/0199681 A1 * 8/2009 Thayer ..... B25B 1/103 81/9.3
2010/0219573 A1 9/2010 O'Rell et al.
2010/0320666 A1 * 12/2010 Teo ..... B25B 1/103 269/43
2011/0316212 A1 * 12/2011 Jones ..... B25B 1/125 269/181
2012/0068393 A1 3/2012 Van de Voss et al.
2012/0169000 A1 * 7/2012 Lin ..... B25B 1/24 269/216
2012/0306138 A1 * 12/2012 Zhang ..... B25B 1/103 269/244
2013/0270760 A1 10/2013 Gordon
2014/0001692 A1 * 1/2014 Schmidt ..... B25B 1/103 269/136
2015/0202744 A1 * 7/2015 Hopey ..... B25B 1/2452 269/153

* cited by examiner

MULTI_STATION FIXTURE VISE

CROSS-REFERENCE TO RELATED APPLICATIONS

This application claims priority to U.S. Provisional application 62/107,051 titled Multi-Station Fixture Vise, filed Jan. 23, 2015, by the same inventors.

BACKGROUND OF THE INVENTION

Technical Field

The present invention relates to a precision tooling fixture for accurately clamping multiple workpieces on a worktable for machining. More specifically, the invention is directed to a compact, two-station fixture vise wherein the workpieces are clamped against oppositely facing features of a common center-mounted fixed vise jaw. A plurality of such vises can be arranged in a precision mechanical array in order to accurately and repeatably present numerous workpieces to a machine tool.

Related Background Art

A tooling fixture is used to hold a workpiece during intricate machining such as computer numerically controlled (CNC) machining. CNC milling and drilling machines are flexible in that they can be programmed to automatically select and install one of a plurality of machine tools from a tool magazine, thereby allowing a wide variety of machining operations to be executed in a single preprogrammed sequence. Thus, if a number, N, of workpieces are to be machined, it can be economical to present an array of workpieces to the CNC machine in a single machining event as compared to N sequential individual machining events. To the extent that all pertinent workpieces can be sequentially machined using each selected tool, then approximately (N−1) tool change intervals can be saved compared to machining individual workpieces.

The fixture used in the CNC array must hold each workpiece securely and precisely. Vises capable of clamping two workpieces and having a fixed center block and movable jaws that move toward the center block are known in the art. But, these Prior Art vises are directed to mounting large and heavy workpieces and are themselves too large and bulky to be arranged into a dense array.

DISCLOSURE OF THE INVENTION

A tooling fixture that provides a compact, multi-station fixture vise is described. The individual workpieces are clamped by separate movable vise jaws against oppositely facing features of a common central fixed vise jaw solidly attached to a baseplate. The movable vise jaws slide on metal support rods that are press fit into the central fixed vise jaw. The movable vise jaws are drawn together toward the central fixed vise jaw by means of a vise screw that passes through the first movable vise jaw and the central fixed vise jaw and is threaded into the second movable vise jaw. Compression springs mounted on the vise screw provide a bias force that causes the movable vise jaws to be drawn simultaneously towards and away from the fixed central vise jaw as the vise screw is rotated.

BRIEF DESCRIPTION OF THE DRAWINGS

Features are numbered equivalently through all drawings.

MODES FOR CARRYING OUT THE INVENTION

Figure 1:
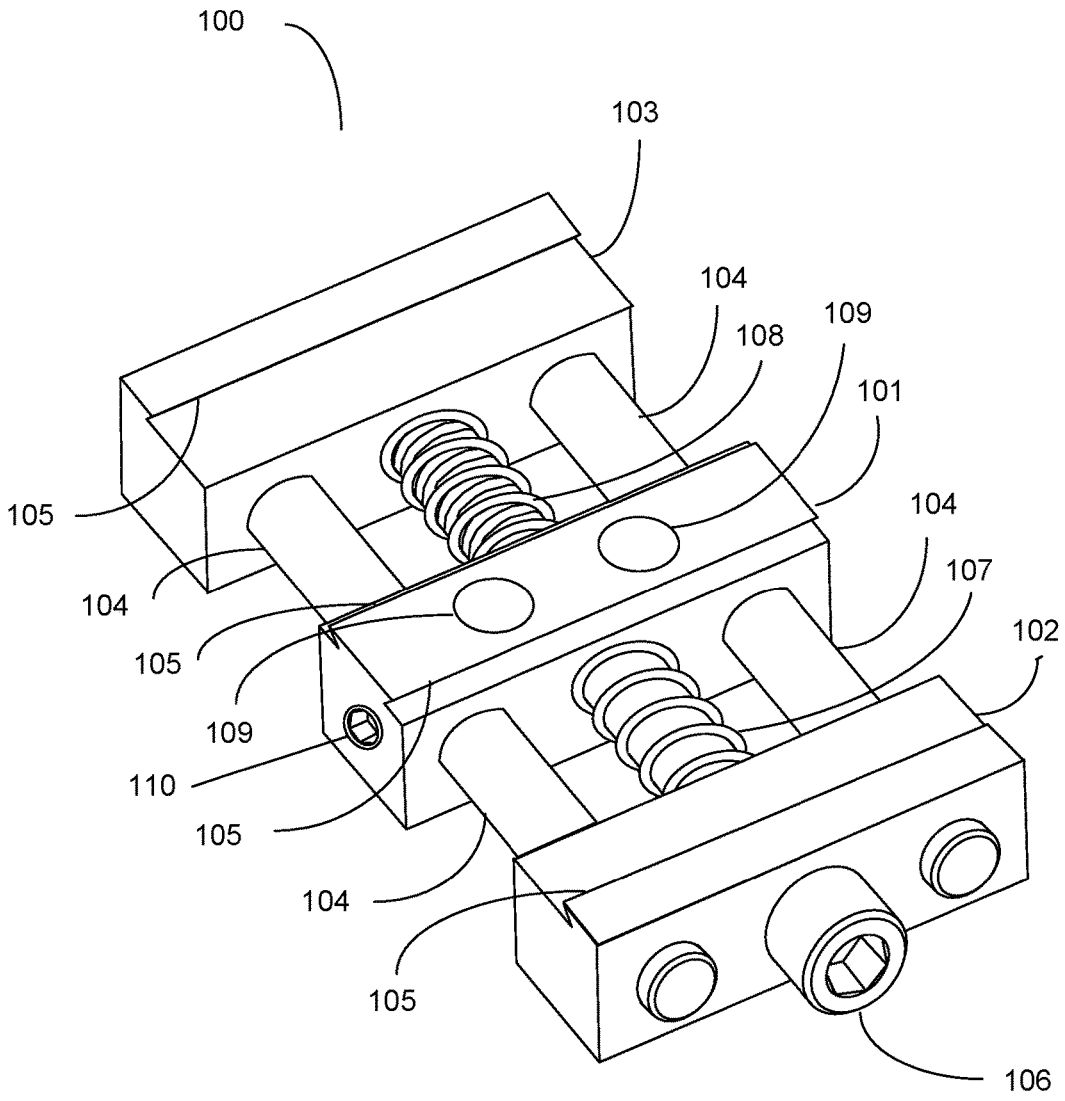
FIG. 1 is a line drawing of an embodiment of the tooling fixture.

Referring to FIG. 1, a tooling fixture 100 is shown. The tooling fixture 100 comprises central vise jaw 101 and right and left movable vise jaws 102 and 103, respectively. The movable vise jaws 102 and 103 slide on support rods 104 that are press fit into the central vise jaw 101. Alternatively, support rods 104 may be inserted into clearance holes drilled in central vise jaw 101 and secured using optional set screws, such as 110. The movable vise jaws 102 and 103 are drawn together toward the central fixed vise jaw 101 by means of a vise screw 106 that is threaded along the distal third of its length. The upper part of the vise screw 106 is milled to clear the threads in the right movable vise jaw 102 and the central fixed vise jaw 101 while the distal third is threaded into the left movable vise jaw 103. Thus, in this embodiment the right movable vise jaw 102 and the left movable vise jaw 103 are identical. The central vise jaw 101 and right and left movable vise jaws 102 and 103, respectively, are shown as incorporating dovetail features 105 to firmly clamp the workpieces that incorporate complementary features. Right and left compression springs 107 and 108, respectively, are mounted on the vise screw 106 to provide a bias force that causes the movable vise jaws to be drawn simultaneously towards and away from the fixed central vise jaw 101. The central vise jaw 101 includes holes 109 for the insertion of screws to mount the fixture to a baseplate or to a work table.

Note that if the stiffness of the left compression spring 108 is larger than the stiffness of the right compression spring 107, then the right movable vise jaw 102 will approach the central fixed vise jaw 101 at a higher rate per turn of the vise screw 106 than will the left movable vise jaw 103. Therefore, a workpiece mounted between the right movable vise jaw 102 and the central fixed vise jaw 101 can be loosely clamped into position while the gap between the left movable vise jaw 103 and the fixed central vise jaw 101 caused by the larger stiffness if the left compression spring 108 allows a similar part to be introduced and clamped with subsequent further tightening of the vise screw 106.

Figure 2:
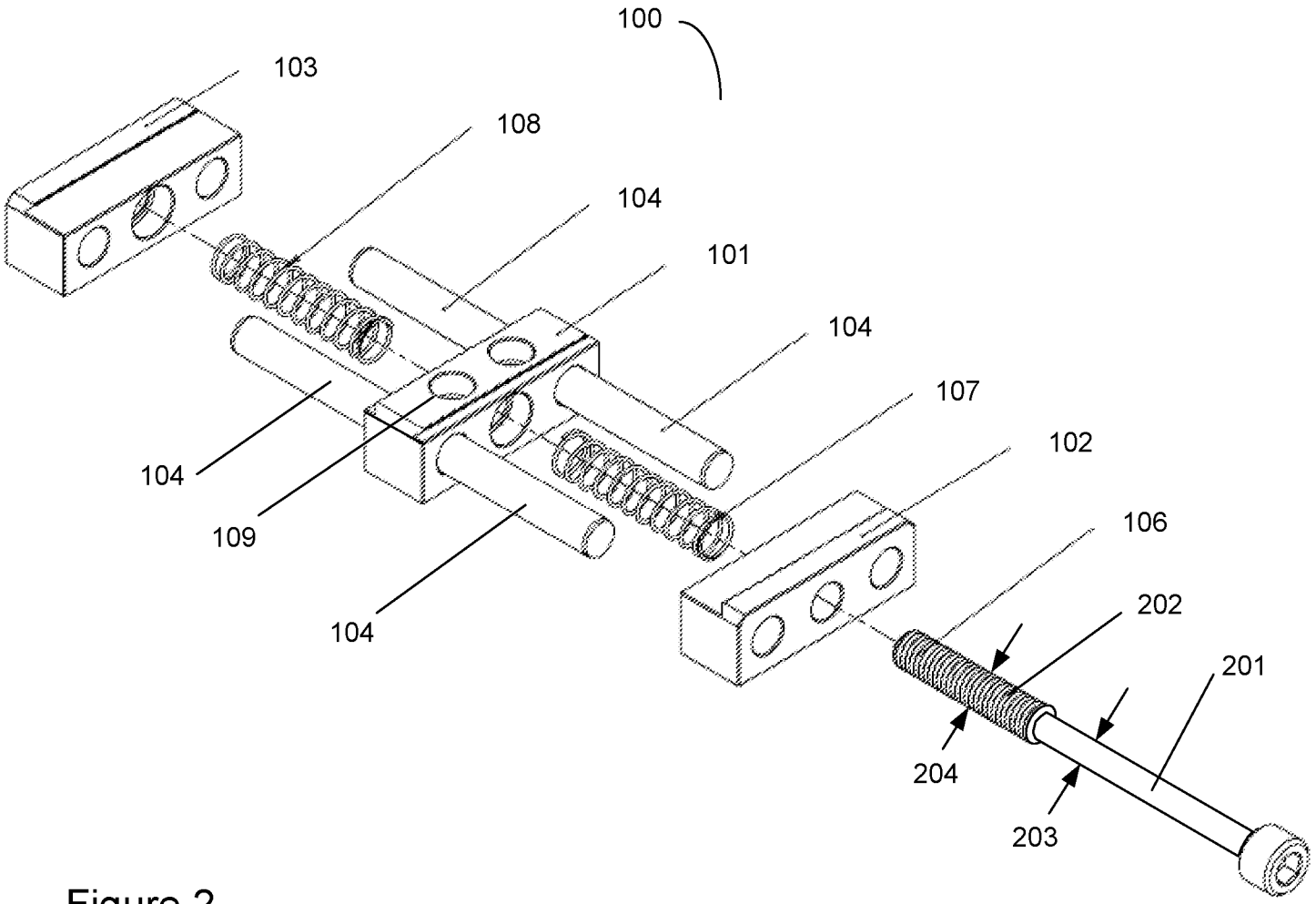
FIG. 2 is an exploded view of the embodiment of FIG. 1.

Referring to FIG. 2, the same tooling fixture 100 as seen in FIG. 1 is shown in an exploded view. Features with the same numbers as those in FIG. 1 have already been described. Note in this view the upper end 201 and the lower end 202 of the screw 106 having diameters 203 and 204, respectively, are visible showing that the upper end is milled with a smaller diameter 203 than the diameter of the lower end 204 in order to clear threads (not visible) within the vise jaw 102.

Figure 3:
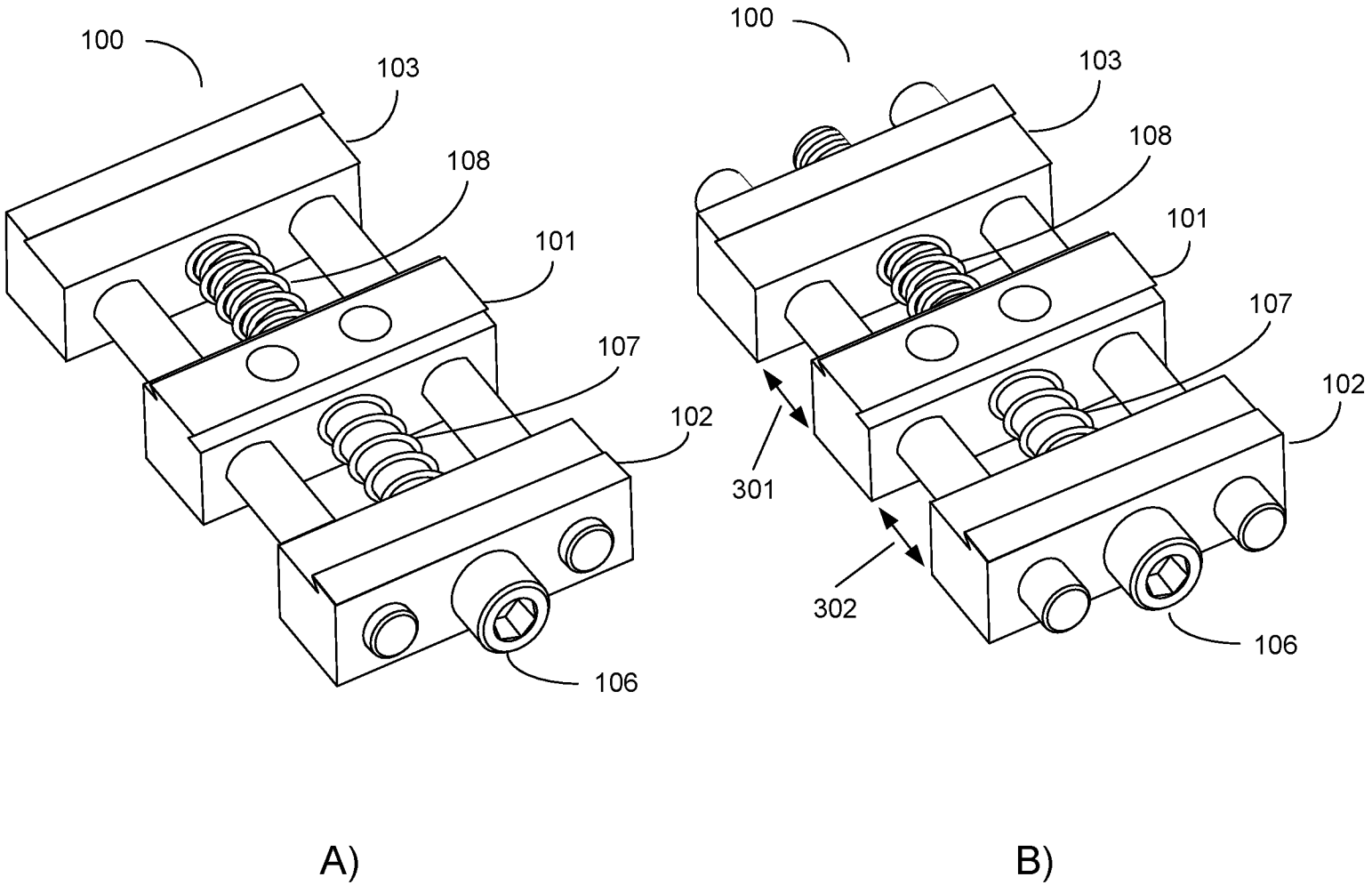
FIG. 3 illustrates the movement of the vise jaws in the embodiment of FIG. 1.

FIG. 3 illustrates the movement of the vise jaws 102 and 103. FIG. 3*a* shows the fully open tooling fixture 100 as shown previously in FIG. 1. FIG. 3*b* shows how the movable vise jaws 102 and 103 have moved toward the fixed central vise jaw 101 because of advancement of the vise screw 106. In this example the stiffnesses of the right and left compression springs 107 and 108, respectively, are assumed to be approximately equal as the gaps 301, 302 are equivalent upon compression of the springs 107, 108.

Figure 4:
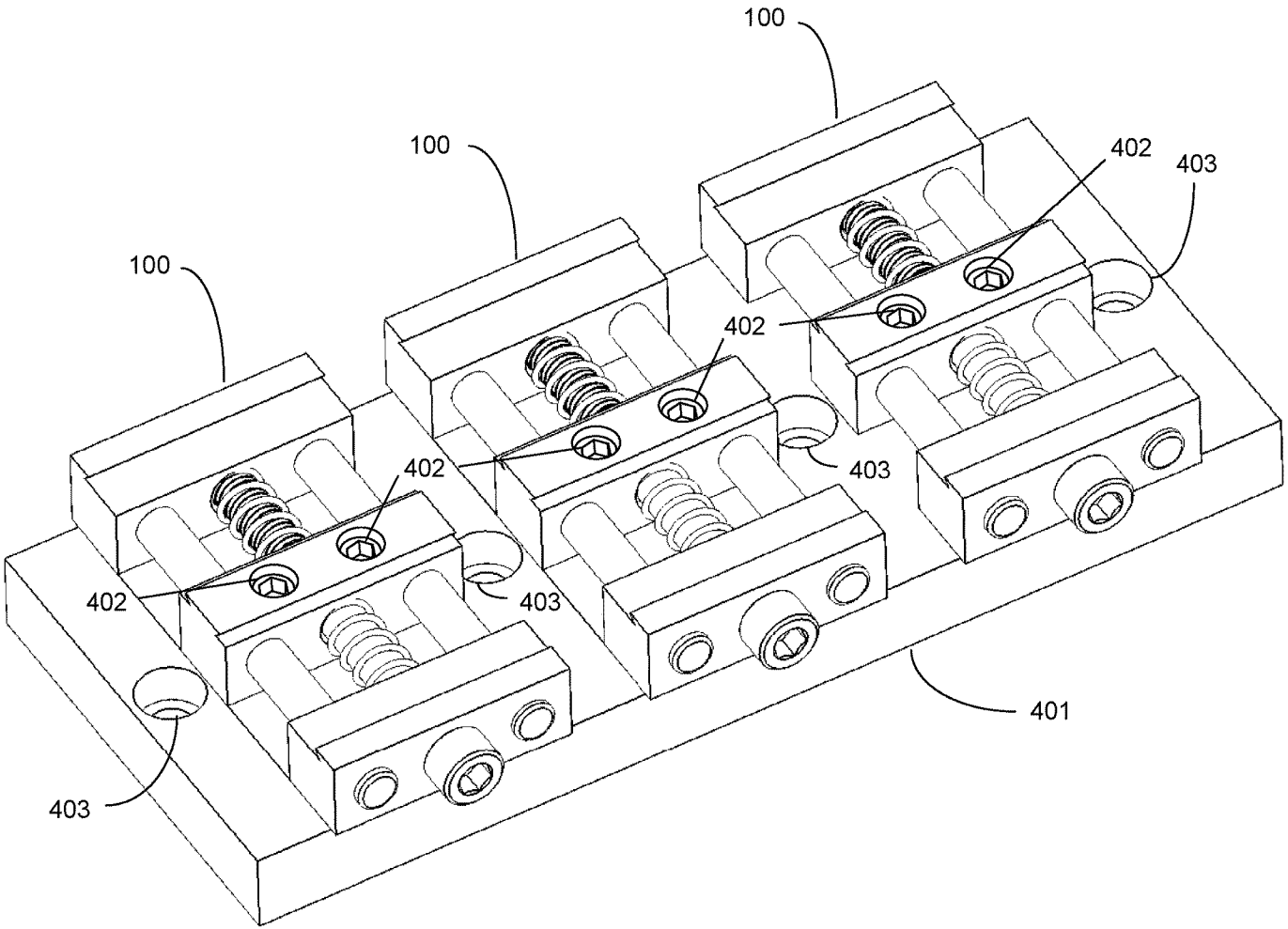
FIG. 4 shows a three unit array of the embodiment of FIG. 1.

FIG. 4 shows an array of three tooling fixtures 100 mounted on a base plate 401. The tooling fixtures 100 are attached to the baseplate 401 by machine screws 402 mounted in mounting holes 109 in the fixed central vise jaws 101. The mounting holes 109 and vice jaws 101 are shown in FIGS. 1 and 2. The baseplate 401 can be attached to a worktable using screws (not shown) inserted through screw holes 403 in the baseplate 401.

Figure 5:
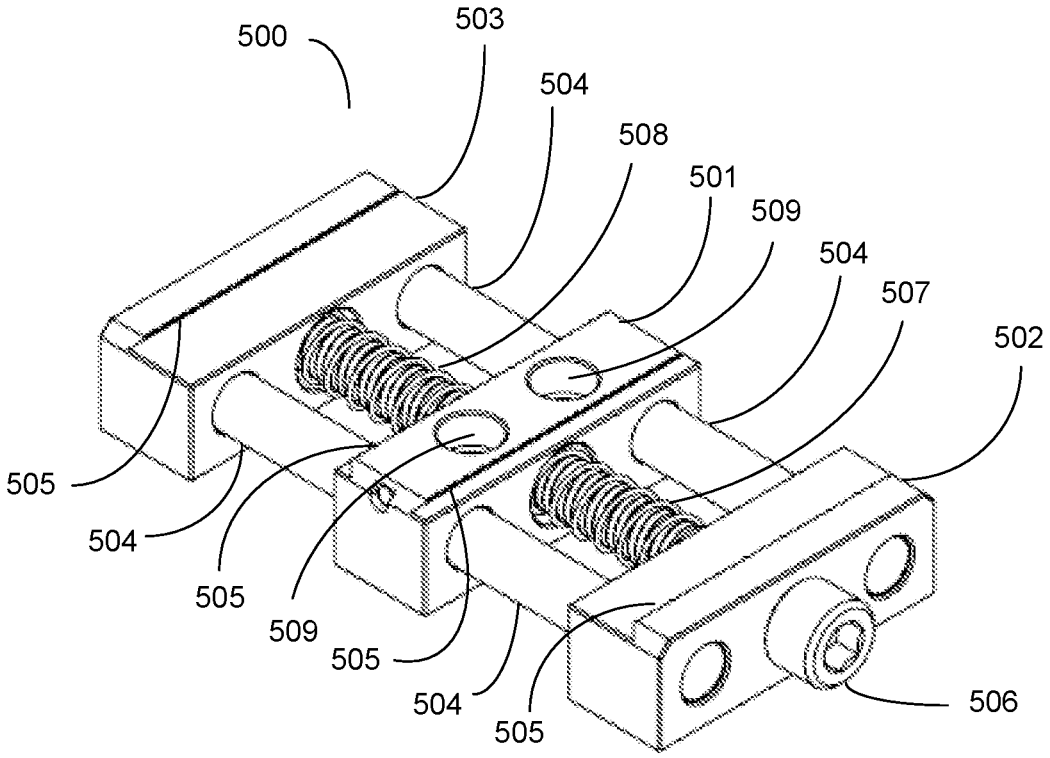
FIG. 5 is a line drawing of a second embodiment of the tooling fixture.

FIG. 5 shows a tooling fixture 500 in an alternate embodiment. The tooling fixture 500 comprises central vise jaw 501 and right and left movable vise jaws 502 and 503, respectively. The movable vise jaws 502 and 503 slide on support rods 504 that are press fit into the central vise jaw 501. The movable vise jaws 502 and 503 are drawn together toward the central fixed vise jaw 501 by means of a vise screw 506 that is threaded along its entire length. The right movable vise jaw 502 and the central fixed vise jaw 501 are drilled to clear the threads of vise screw 506 while the left movable vise jaw 503 is tapped to accept the threads of the vise screw 506. Thus, in this embodiment the right movable vise jaw 502 and the left movable vise jaw 503 are different. The central vise jaw 501 and right and left movable vise jaws 502 and 503, respectively, are shown as incorporating dovetail features 505 to firmly clamp the workpieces that incorporate complementary features. Right and left compression springs 507 and 508, respectively, are mounted on the vise screw 506 to provide a bias force that causes the movable vise jaws to be drawn simultaneously towards and away from the fixed central vise jaw 501. The central vise jaw 501 includes holes 509 for the insertion of screws to mount the fixture to a baseplate or to a work table.

Figure 6:
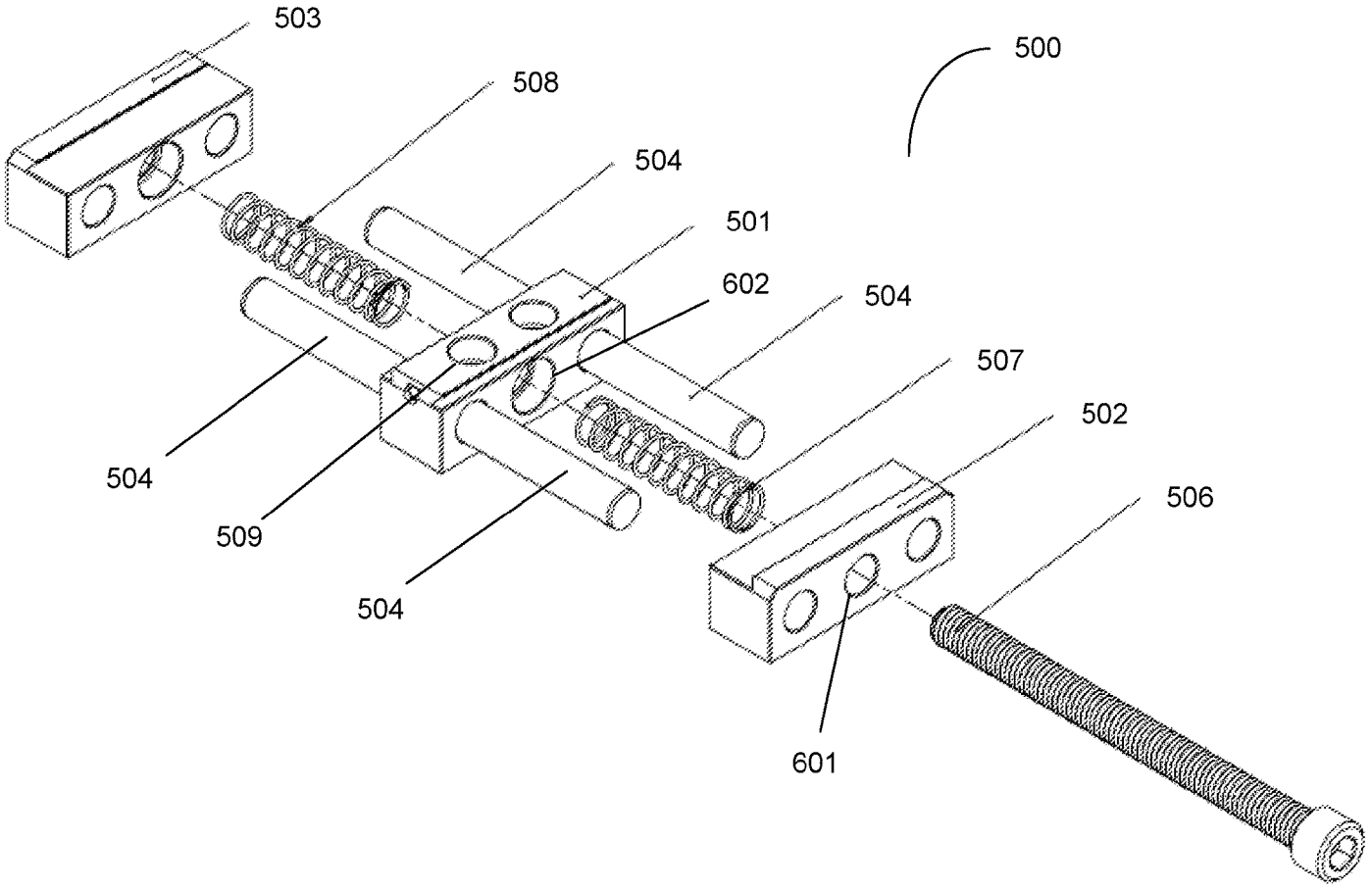
FIG. 6 is an exploded view of the embodiment of FIG. 5.

Referring to FIG. 6, the same tooling fixture 500 as seen in FIG. 5 is shown in an exploded view. Features with the same numbers as those in FIG. 5 have already been described. The holes 601, 602 are milled to clear the screw 506. In this view the screw 506 is seen to be threaded along its entire length.

Figure 7:
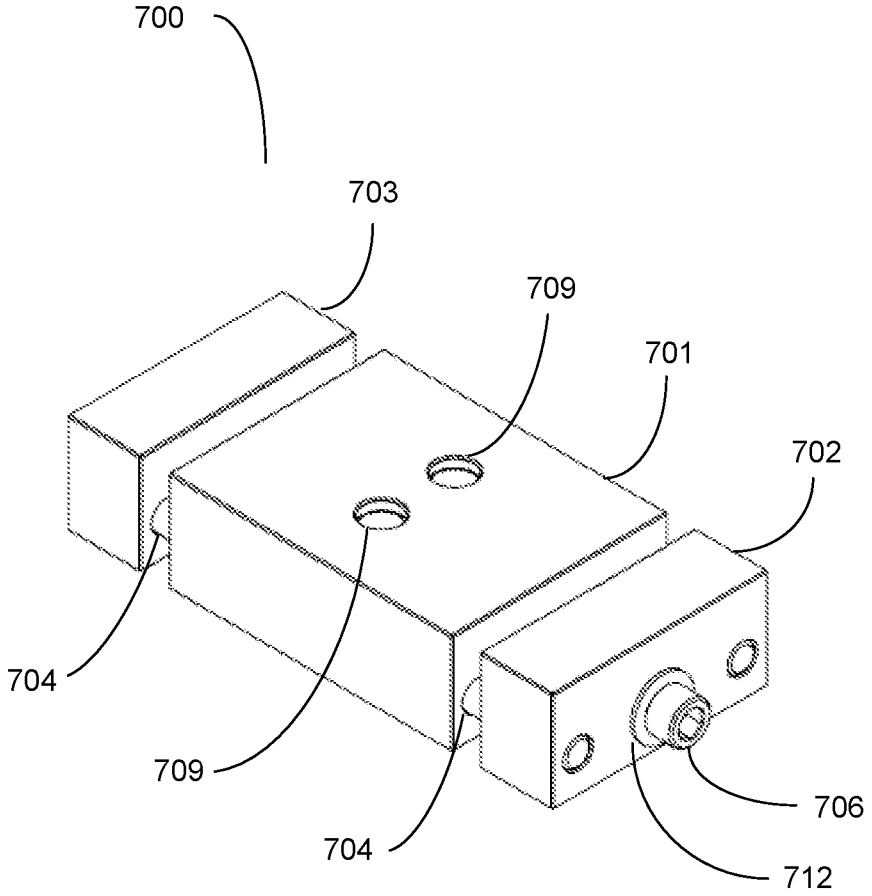
FIG. 7 is a line drawing of a third embodiment of the tooling fixture.

FIG. 7 shows a tooling fixture 700 in another alternate embodiment. The tooling fixture 700 comprises central vise jaw 701 and right and left movable vise jaws 702 and 703, respectively. The movable vise jaws 702 and 703 slide on support rods 704 that are press fit into the central vise jaw 701. The movable vise jaws 702 and 703 are drawn together toward the central fixed vise jaw 701 by means of a vise screw 706 that is threaded along at least a portion of its length. The right movable vise jaw 702 and the central fixed vise jaw 701 are drilled to clear the threads of vise screw 706 while the left movable vise jaw 703 is tapped to accept the threads of the vise screw 706. Thus, in this embodiment the right movable vise jaw 702 and the left movable vise jaw 703 are different. The central vise jaw 701 and right and left movable vise jaws 702 and 703, respectively, are manufactured using aluminum or light steel that can be machined to provide custom clamping surfaces for secondary machining of specific workpieces. Right and left compression springs are not shown in this view. The central vise jaw 701 includes holes 709 for the insertion of screws to mount the fixture to a baseplate or to a work table.

Figure 8:
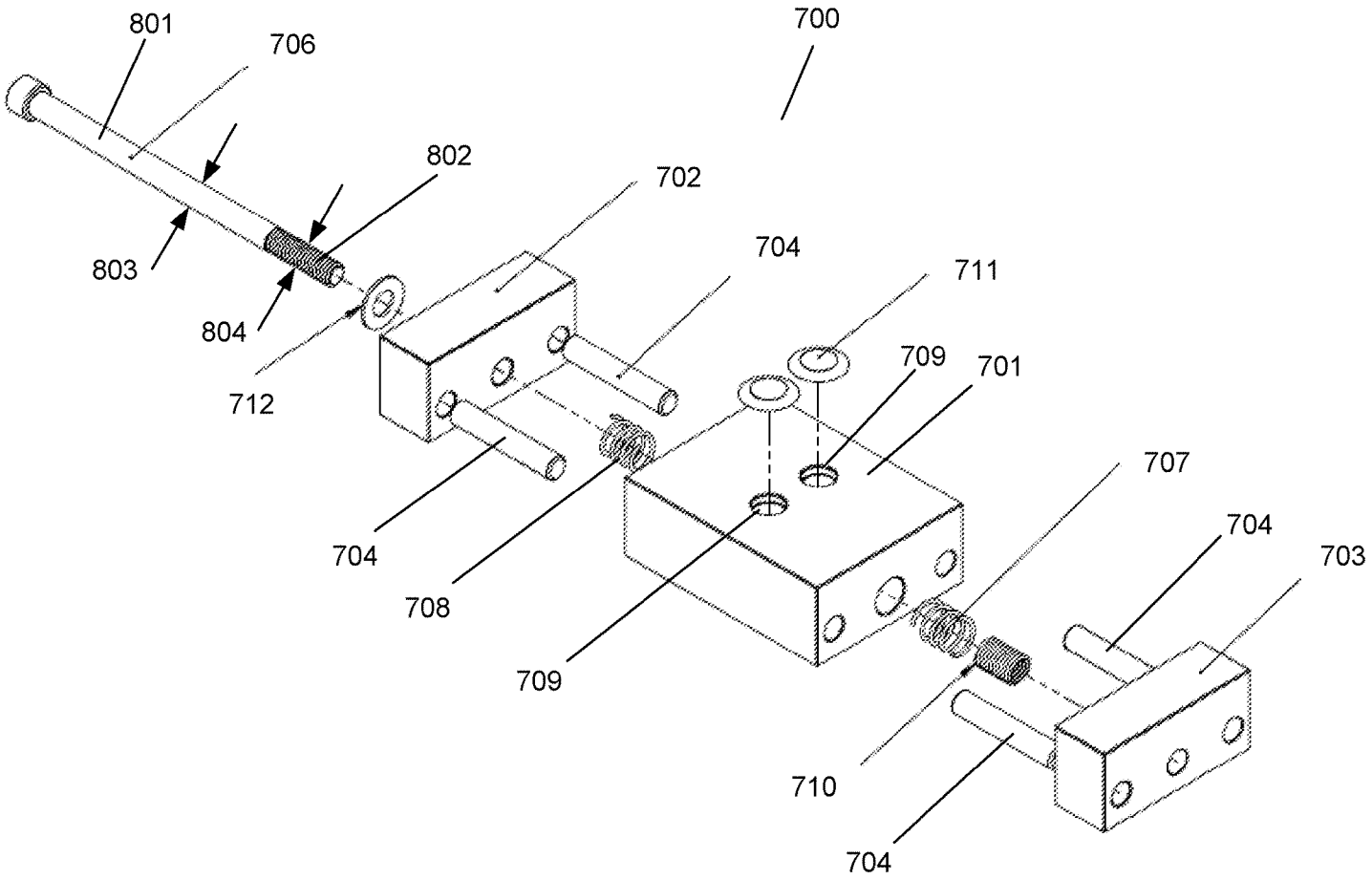
FIG. 8 is an exploded view of the embodiment of FIG. 7.

Referring to FIG. 8 the same tooling fixture 700 as seen in FIG. 7 is shown in an exploded view. Features with the same numbers as those in FIG. 7 have already been described. Right and left compression springs 707 and 708, respectively, are shown in this view. In this view, vise screw 706 is shown to include an upper end 801 and a lower end 802, which is threaded. The diameter 803 of the upper end 801 is nominally the same as the outer diameter 804 of the lower end 802. Also shown is helical insert 710 to provide robust tapping to match the threads of the vise screw 706 in the softer metal of the machinable left movable vise jaw 703. The figure also shows plastic covers 711 for the mounting holes in the fixed central vise jaw 701 and a washer 712 to prevent the head of the vise screw 706 from scoring the soft metal of the machinable right movable vise jaw 702.

Figure 9:
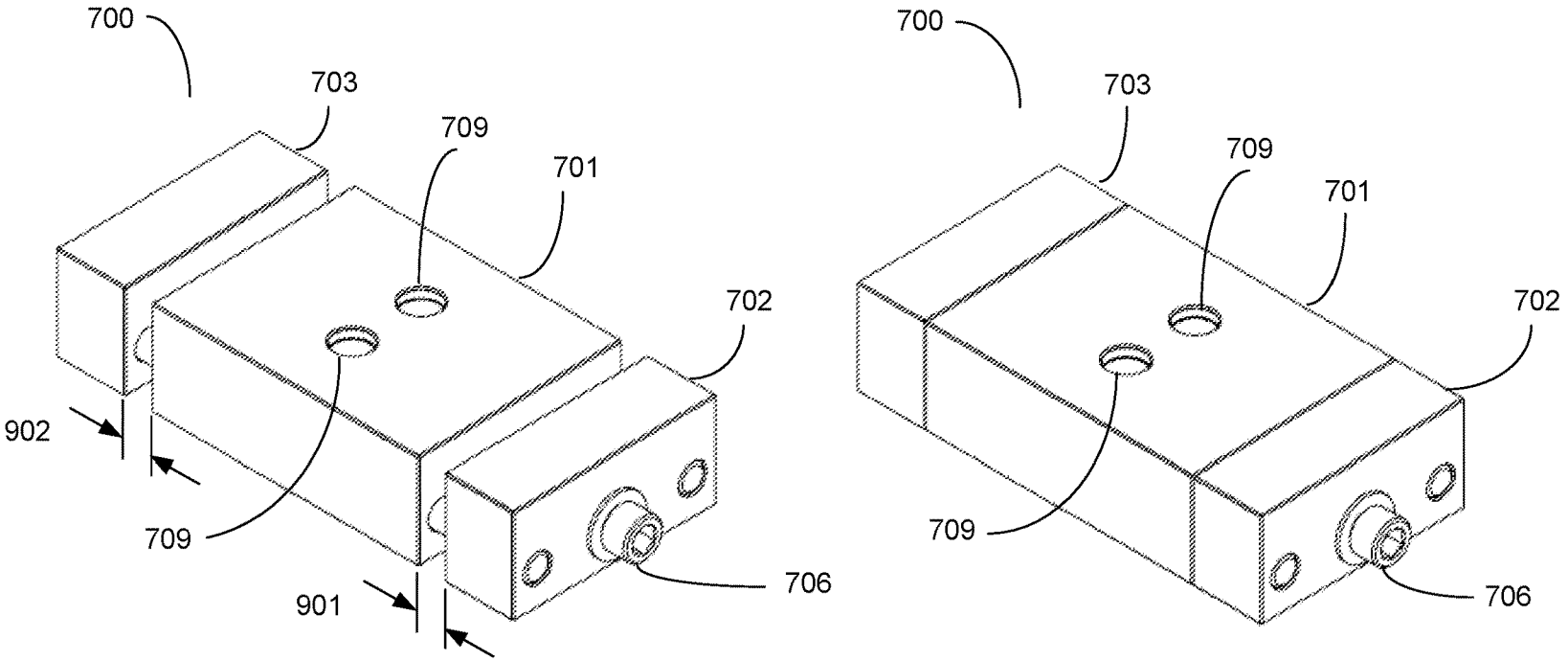
FIG. 9 illustrates the movement of the vise jaws in the embodiment of FIG. 7.

FIG. 9 illustrates the movement of the vise jaws 702 and 703. FIG. 9*a* shows the fully open tooling fixture 700 as shown previously in FIG. 7. FIG. 9*b* shows how the movable vise jaws 702 and 703 have moved toward the fixed central vise jaw 701 because of advancement of the vise screw 706. In this example the stiffnesses of the right and left compression springs 707 and 708, respectively, are assumed to be approximately equal as the gaps 901, 902 are equivalent.

Figure 10:
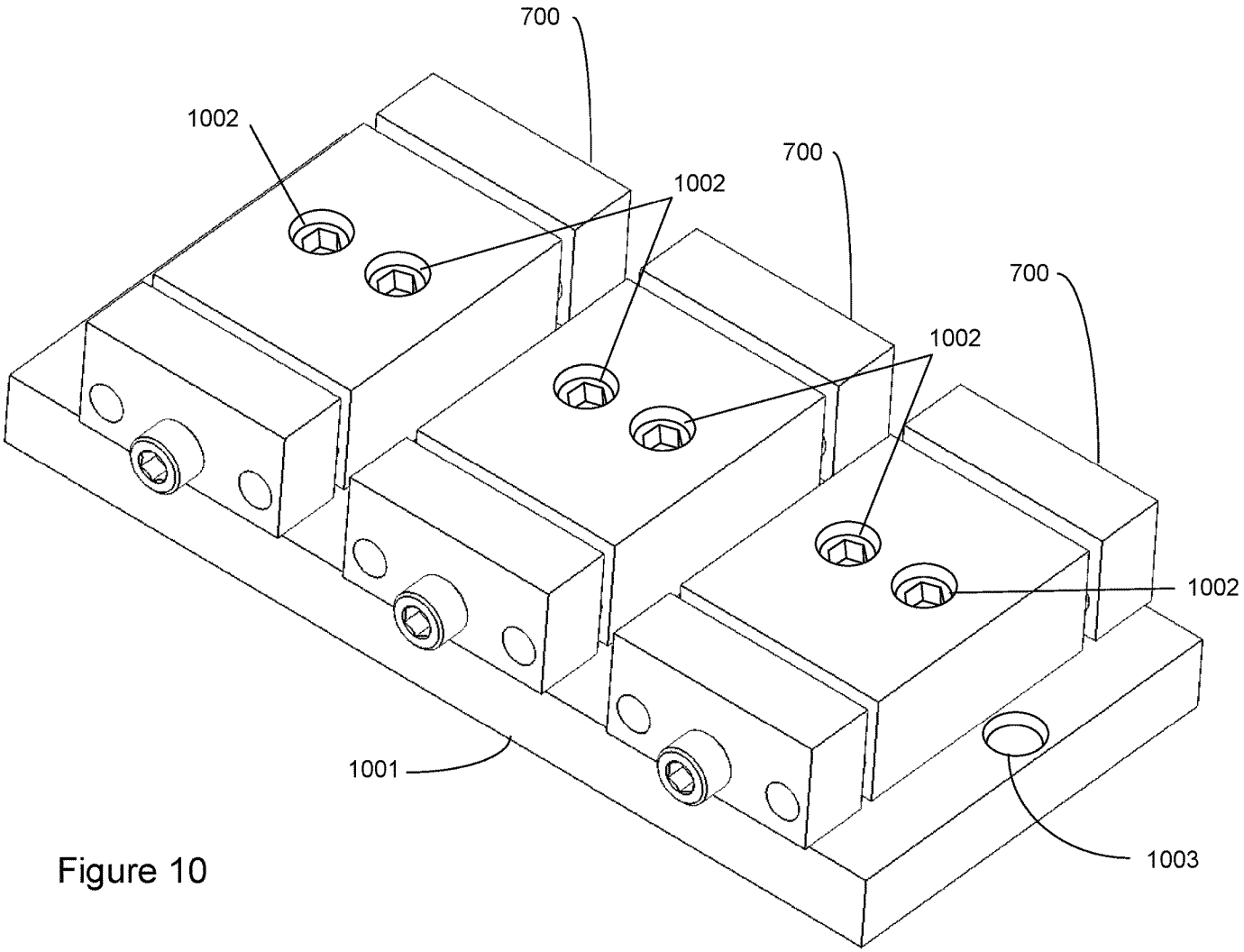
FIG. 10 shows a three unit array of the embodiment of FIG. 7.

FIG. 10 shows an array of three tooling fixtures 700 mounted on a base plate 1001. The tooling fixtures 700 are attached to the baseplate 1001 by machine screws 1002 mounted in mounting holes 709 in the fixed central vise jaw 701. The baseplate 401 can be attached to a worktable using screws (not shown) inserted through screw holes 1003 in the baseplate 1001.

Figure 11:
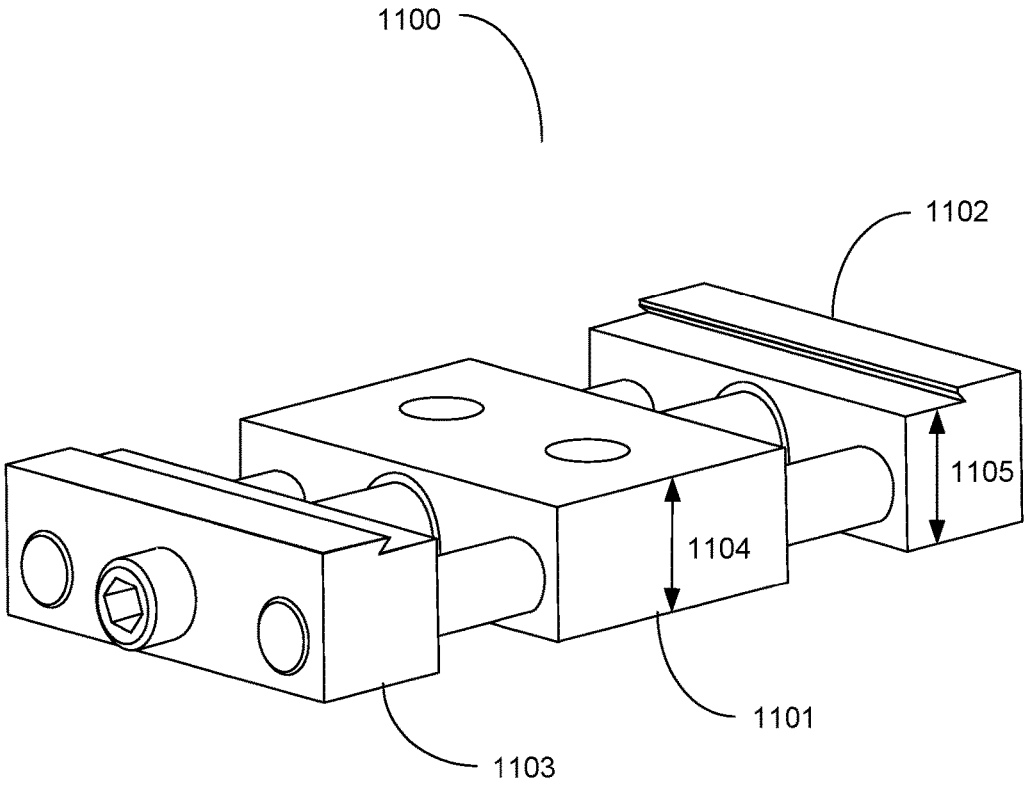
FIG. 11 is a line drawing of a fourth embodiment of the tooling fixture.

FIG. 11 shows a tooling fixture 1100 in yet another embodiment. This version is the same as the fixtures shown earlier in FIG. 1 and FIG. 5, except that the fixed central vise jaw has been eliminated and replaced with a fixed central platform 1101 having the same height 1104 as the base of the dovetail features 1105 in the left and right movable vice jaws 1102 and 1103, respectively. Thus, this embodiment serves as a single-station fixture vise for oversized workpieces.

SUMMARY

A tooling fixture that provides a compact, multi-station fixture vise is described. The design provides a compact, robust tooling fixture that is easily assembled into multi-unit arrays for machining of large volumes of workpieces.

Those skilled in the art will appreciate that various adaptations and modifications of the preferred embodiments can be configured without departing from the scope and spirit of the invention. Therefore, it is to be understood that the invention may be practiced other than as specifically described herein, within the scope of the appended claims.

What is claimed is:

1. A multi-station fixture vise for simultaneously clamping a plurality of workpieces, said vise comprising:

a) a base including a base plate, b) a vise screw comprising a cylindrical body having a diameter and a length extending from a first end to a second end, and a head located at said first end wherein:

i) the body is threaded along at least a portion of its length, the diameter of the unthreaded portion of the body being the same as the diameter of the threaded portion, and ii) the head has a diameter greater than the diameter of the threaded portion of the body and is configured to engage with an external tightening tool, c) one fixed jaw, said fixed jaw consisting of a single unit, the single unit having top and bottom faces, parallel front and back faces perpendicular to said bottom face, and left and right side faces, and, said fixed jaw fixably attached at said bottom face to said base plate and having first and second clamping surfaces disposed on said front and back faces of said fixed jaw, respectively, wherein:

i) two guide rods are fixably mounted directly on each of the first and second clamping surface perpendicular to each of the first and second clamping surface, ii) a first clearance hole for said vise screw is drilled through said fixed jaw perpendicular to the first and second clamping surfaces, and iii) clamping features are attached to or machined into each of the first and second clamping surfaces, d) a first movable jaw having a third clamping surface arranged parallel to said first clamping surface of said fixed jaw, wherein:

i) second and third clearance holes are drilled through said first movable jaw perpendicular to said third clamping surface, said second and third clearance holes being disposed to admit said guide rods mounted directly to said first clamping surface of said fixed jaw and allowing said first movable jaw to slide on said guide rods, ii) a fourth clearance hole for said vise screw is drilled through said first movable jaw perpendicular to said third clamping surface, said fourth clearance hole being disposed to align with the first clearance hole drilled in said fixed jaw when said first movable jaw is mounted directly on said guide rods, and iii) clamping features are attached to or machined into said third clamping surface, e) a second movable jaw having a fourth clamping surface arranged parallel to said second clamping surface of said fixed jaw, wherein:

i) fifth and sixth clearance holes are drilled through said second movable jaw perpendicular to said fourth clamping surface, said fifth and sixth clearance holes being disposed to admit said guide rods mounted directly to said second clamping surface of said fixed jaw and allowing said second movable jaw to slide on said guide rods, ii) a threaded hole is drilled through said second movable jaw perpendicular to said fourth clamping surface and tapped to engage with said vise screw, said threaded hole being disposed to align with the first clearance hole drilled in said fixed jaw when said second movable jaw is mounted directly on said guide rods, and iii) clamping features are attached to or machined into said fourth clamping surface, f) wherein said vise screw is inserted through said fourth clearance hole in said first movable jaw, through said first clearance hole in said fixed jaw, and threaded into said threaded hole in said second movable jaw, g) wherein a first compression spring having a length and a stiffness is installed coaxially on said vise screw between said first movable jaw and said fixed jaw, and a second compression spring having a length and a stiffness is installed coaxially on said vise screw between said fixed jaw and said second movable jaw, h) wherein the lengths and stiffnesses of said first and second compression springs are equal and the lengths are adjusted to be under slight compression when said vise screw is threaded into said second movable jaw, and i) wherein axial motion of said vise screw causes first and second movable jaws to move towards each other or away from each other.

2. The multi-station fixture vise of claim 1 wherein the body of the vise screw is fully threaded.

3. The multi-station fixture vise of claim 1 wherein the body of the vise screw is threaded at the second end of the body for approximately one-third of its length.

4. The multi-station fixture vise of claim 1 wherein the stiffnesses of the first and second compression springs are different.

5. A multi-station fixture vise for simultaneously clamping a plurality of workpieces, said vise comprising:

a) a base including a base plate, b) a vise screw comprising a cylindrical body having a diameter and a length extending from a first end to a second end, and a head located at said first end wherein:

i) the body is threaded at said second end for a portion of its length, the diameter of the unthreaded portion of the body being smaller than the diameter of the threaded portion, and ii) the head has a diameter greater than the diameter of the threaded portion of the body and is configured to engage with an external tightening tool, c) one fixed jaw, said fixed jaw consisting of a single unit, the single unit having top and bottom faces, parallel front and back faces perpendicular to said bottom face, and left and right side faces, and, said fixed jaw fixably attached at said bottom face to said base plate and having first and second clamping surfaces disposed on said front and back faces of said fixed jaw, respectively, wherein:

i) two guide rods are fixably mounted directly on each of the first and second clamping surface perpendicular to each of the first and second clamping surface, ii) a first threaded hole for said vise screw is drilled through said fixed jaw perpendicular to the first and second clamping surfaces and tapped to engage with said vise screw, and iii) clamping features are attached to or machined into each of the first and second clamping surface, d) a first movable jaw having a third clamping surface arranged parallel to said first clamping surface of said fixed jaw, wherein:

i) first and second clearance holes are drilled through said first movable jaw perpendicular to said the third clamping surface, the first and second clearance holes being disposed to admit said guide rods directly mounted to said first clamping surface of said fixed jaw and allowing said first movable jaw to slide on said guide rods, ii) a second threaded hole for said vise screw is drilled through said first movable jaw perpendicular to said third clamping surface and tapped to engage with said vise screw, said second threaded hole being disposed to align with the first threaded hole drilled in said fixed jaw when said first movable jaw is mounted directly on said guide rods, and iii) clamping features are attached to or machined into said third clamping surface, e) a second movable jaw having a fourth clamping surface arranged parallel to said second clamping surface of said fixed jaw, wherein:

i) third and fourth clearance holes are drilled through said second movable jaw perpendicular to said fourth clamping surface, said third and fourth clearance holes being disposed to admit said guide rods mounted directly to said second clamping surface of said fixed jaw and allowing said second movable jaw to slide on said guide rods, ii) a third threaded hole is drilled through said second movable jaw perpendicular to said fourth clamping surface and tapped to engage with said vise screw, said third threaded hole being disposed to align with the first threaded hole drilled in said fixed jaw when said second movable jaw is mounted directly on said guide rods, and iii) clamping features are attached to or machined into said fourth clamping surface, f) wherein said vise screw is threaded through said second threaded hole in said first movable jaw, threaded through said first threaded hole in said fixed jaw, and threaded into said third threaded hole in said second movable jaw, g) wherein a first compression spring having a length and a stiffness is installed coaxially on said vise screw between said first movable jaw and said fixed jaw, and a second compression spring having a length and a stiffness is installed coaxially on said vise screw between said fixed jaw and said second movable jaw, h) wherein the lengths and stiffnesses of said first and second compression springs are equal and the lengths are adjusted to be under slight compression when said vise screw is threaded into said second movable jaw, and i) wherein axial motion of said vise screw causes first and second movable jaws to move towards each other or away from each other.

6. The multi-station fixture vise of claim 5 wherein the body of the vise screw is threaded at the second end of the body for approximately one-third of its length.

7. The multi-station fixture vise of claim 5 wherein the stiffnesses of the first and second compression springs are different.

8. A multi-station fixture vise for simultaneously clamping a plurality of workpieces, said vise comprising:

a) a base including a base plate, b) a vise screw comprising a cylindrical body having a diameter and a length extending from a first end to a second end, and a head located at said first end wherein:

i) the cylindrical body is threaded along at least a portion of its length, the diameter of the unthreaded portion of the cylindrical body being the same as the diameter of the threaded portion, and ii) the head has a diameter greater than the diameter of the threaded portion of the cylindrical body and is configured to engage with an external tightening tool, c) a central body, consisting of a single unit, said single unit having at least top and bottom faces, parallel front and back faces perpendicular to said bottom face, and left and right side faces, and, said central body fixably attached at said bottom face to said base, wherein:

i) two guide rods are fixably mounted directly on each front and back face perpendicular to each face, and ii) a first clearance hole for said vise screw is drilled through said central body perpendicular to the front and back faces, d) a first movable jaw having a first clamping surface arranged parallel to said front face of said central body, wherein:

i) second and third clearance holes are drilled through said first movable jaw perpendicular to said clamping surface, said second and third clearance holes being disposed to admit said guide rods directly mounted to said front face of said central body and allowing said first movable jaw to slide on said guide rods, ii) a fourth clearance hole for said vise screw is drilled through said first movable jaw perpendicular to said first clamping surface, said fourth clearance hole being disposed to align with the first clearance hole drilled in said central body when said first movable jaw is directly mounted on said guide rods, and iii) clamping features are attached to or machined into said first clamping surface, e) a second movable jaw having a second clamping surface arranged parallel to said back face of said central body, wherein:

i) fifth and sixth clearance holes are drilled through said second movable jaw perpendicular to said second clamping surface, said fifth and sixth clearance holes being disposed to admit said guide rods directly mounted to said back face of said central body and allowing said second movable jaw to slide on said guide rods, ii) a threaded hole is drilled through said second movable jaw perpendicular to said second clamping surface and tapped to engage with said vise screw, said threaded hole being disposed to align with the first clearance hole drilled in said central body when said second movable jaw is directly mounted on said guide rods, and iii) clamping features are attached to or machined into said second clamping surface, f) wherein said vise screw is inserted through said fourth clearance hole in said first movable jaw, through said first clearance hole in said central body, and threaded into said threaded hole in said second movable jaw, g) wherein a first compression spring having a length and a stiffness is installed coaxially on said vise screw between said first movable jaw and said central body, and a second compression spring having a length and a stiffness is installed coaxially on said vise screw between said central body and said second movable jaw, h) wherein the lengths of said first and second compression springs are equal and are adjusted to be under slight compression when said vise screw is threaded into said second movable jaw, and i) wherein axial motion of said vise screw causes first and second movable jaws to move towards each other or away from each other.

9. The multi-station fixture vise of claim 8 wherein the body of the vise screw is fully threaded.

10. The multi-station fixture vise of claim 8 wherein the body of the vise screw is threaded at the second end of the body for approximately one-third of its length.

* * * * *